US005160022A

United States Patent [19]

Mennella

[11] Patent Number: 5,160,022

[45] Date of Patent: Nov. 3, 1992

[54] SAMPLE PACKET AND MEDIA MAILING SYSTEM

[75] Inventor: Louis P. Mennella, Princeton Junction, N.J.

[73] Assignee: Flexpaq Corporation, South Plainfield, N.J.

[21] Appl. No.: 816,755

[22] Filed: Jan. 2, 1992

[51] Int. Cl.[5] ..... B65D 75/54

[52] U.S. Cl. ..... 206/232; 132/333; 206/581; 206/823; 283/56

[58] Field of Search ..... 132/317, 320, 333; 206/229, 232, 459, 581, 823; 283/56

[56] References Cited

U.S. PATENT DOCUMENTS

| | | | |
|---|---|---|---|
| 1,850,369 | 3/1932 | Andrews . | |
| 2,069,332 | 2/1937 | Salfisberg | 206/459 |
| 2,652,149 | 9/1953 | O'Meara | 206/232 |
| 2,764,829 | 10/1956 | Kingman . | |
| 3,076,541 | 2/1963 | Volckening . | |
| 3,583,729 | 6/1971 | DeGroot | 206/232 |
| 4,255,872 | 3/1981 | Williams, Sr. | 206/232 |
| 4,260,055 | 4/1981 | Slaybaugh | 206/232 |
| 4,433,780 | 2/1984 | Ellis | 206/232 |
| 4,487,431 | 12/1984 | Kelly | 206/232 |
| 4,492,306 | 1/1985 | Cooper et al. . | |
| 4,706,996 | 11/1987 | Fasham | 206/232 |
| 4,711,348 | 12/1987 | Schluger | 206/232 |
| 4,759,494 | 7/1988 | Smyth . | |
| 4,925,029 | 5/1990 | Friedman et al. . | |
| 4,941,574 | 7/1990 | Meehan . | |
| 4,988,124 | 1/1991 | Hudetz | 283/56 |

*Primary Examiner*—Jimmy G. Foster

*Attorney, Agent, or Firm*—Mathews, Woodbridge & Collins

[57] ABSTRACT

A flexible, sample-containing, multi-compartment packet has printed material attached for distribution through the mail. At least two compartments of the packet are separated by a sealed zone and form a spine when said packet is folded. Folded, printed material is attached to the spine of the packet. After the printed material is attached to the packet, it is distributed through the mail. The packet is tough and made of rugged material so that it will not rupture or burst when mailed.

9 Claims, 2 Drawing Sheets

SAMPLE PACKET AND MEDIA MAILING SYSTEM

BACKGROUND OF THE INVENTION

1. Field of the Invention

This invention relates to a multi-compartment, product sample-containing packet with printed material attached for distribution through the mail.

2. Description of Prior Art

It is known in the art to provide samples of various products to consumers by packaging the samples in small vials, bottles or packets. Distribution of these samples through the mail in the past has been ineffective, expensive, and wasteful. Prior to the present invention, small bottles containing samples have been packaged in separate boxes for mailing purposes. Literature regarding the sample is placed inside the boxes or arrives separately from the sample. This is an ineffective and expensive method of distributing the sample and a waste of packaging It is also known to distribute samples in small vials by handing them to potential customers in stores. These vials are held in place by a slot in a cardboard holder.

A device for mailing vials is described in U.S. Pat. No. 4,925,029 wherein a combination mailer packet has a vial positioned between opposable leaves.

Liquid samples contained in packets are also publicly distributed. It is known in the art to attach these sample packets to magazines. For example, U.S. Pat. No. 4,941,574 describes a liquid sample envelope supported within an envelope intended for insertion into a publication for purposes of distribution through U.S. Pat. No. 4,759,494 describes attaching a printed distribution message to the margin or sealed edge of a liquid-proof envelope package for identification purposes.

U.S. Pat. Nos. 4,492,306; 3,076,541; 2,764,829; and 1,850,369 are also of possible relevance with respect to the general state of the art.

SUMMARY OF THE INVENTION

Briefly described, the invention comprises a flexible, product sample-containing, multi-compartment packet. A sample product is contained in one or more cells or compartments. The sample contained within the compartments can be liquid, powder or other similar substance. The compartments are sealed along the adjoining edges. Laminates are used in forming the packets. The compartments are substantially non-permeable. Each compartment is separated by a sealed zone or spine. The spine is perforated, or has a fragmentation line which permits the compartments to be separated.

Printed material is attached to the sealed zone. Means for attaching the printed material include stitching, gluing or stapling. The printed material may include an area for placing mailing information for purposes of distribution through the mail. The printed material can be folded once or more and when folded forms a folio. Information regarding the product, or advertising may also be found on the printed material.

If printed material containing mailing information is attached to the spine, the packet is folded along the perforation with the mailing information on the outside of the packet, forming a booklet. The booklet is then ready for distributing through the mail.

The packet may have more than two compartments and more than one folio. Also, the folio can be attached either to the inside or outside surface of the packet or both. Use of the packet is not limited to direct mail, but can be used as a hand-out, take-one, or product insert in different applications.

The invention may be more fully understood by reference to the following drawings.

DETAILED DESCRIPTION OF THE PREFERRED EMBODIMENT

During the course of this description like numbers will be used to identify like elements according to the different views which illustrate the invention.

Figure 1A:
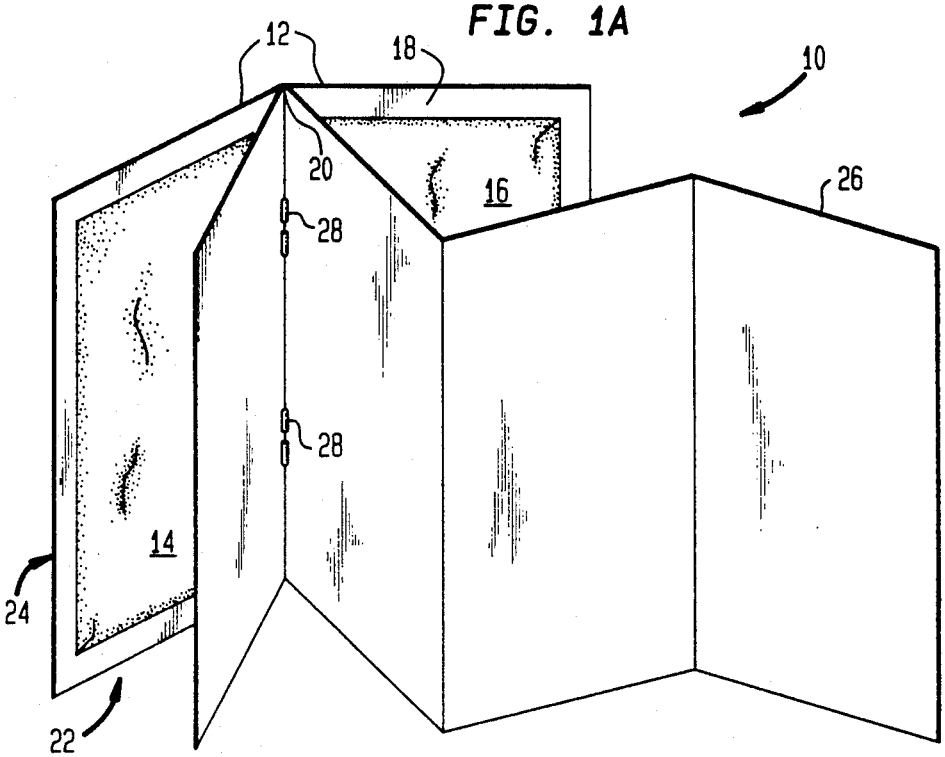
FIG. 1A is a front view of the invention showing a booklet with one folio attached to the inside of a tandem, two compartment packet.
Figure 1B:
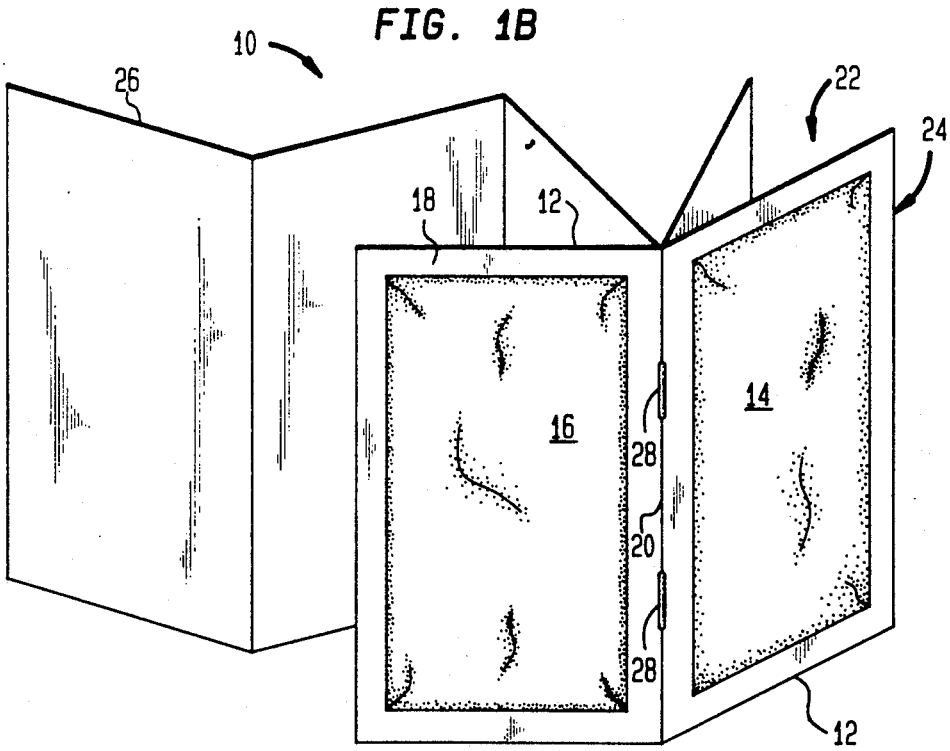
FIG. 1B is a rear view of the embodiment of FIG. 1A.

A booklet 10 with one inside folio 26 according to the preferred embodiment of the present invention is illustrated in FIGS. 1A and 1B. The booklet 10 includes a multi-compartment packet 12. The packet 12 typically holds a liquid or other sample substance. Two packets 14 and 16 comprise the multi-compartment packet 12 which is also referred to as a "tandem". A sample of a liquid or other substance is contained within at least one packet 14 or 16. The edges of the multi-compartment packet 12 are sealed along seam 18. A sealed binding line or spine 20 separates packets 14 and 16. The spine 20 may be perforated or have a fold line impressed therein. The packet 12 can be folded along the spine 20 making it more compact.

Attached along the spine 20 is a folio 26 containing printed material or information. The folio 26 has one or more folds. As shown in FIG. 1A, staples 28 attach the folio 26 to the spine 20. Folio 26 can also be attached to the tandem packet 12 by stitching or gluing. The folio 26 is either printed with an address or information advertising the sample product contained in the packets 14 and 16. The folio 26 can either be attached to the inside face 22 or the outside face 24 of the packet 12. In FIGS. 1A and 1B, the folio 26 is shown attached to the inside face 22 of the packet 12.

When the folio 26 is attached along the spine 20, it can be folded numerous ways, depending on the intended use of the booklet 10. Fields for placing mailing information such as addressee, return address and postage may be located on the tandem pocket 12 or on the folio 26 depending upon the circumstances. The dimensions of the folded packet 12 are at least 3.5 inches by 5 inches, in order to comply with U.S. Postal Regulations FIG. 1B is a rear view of the embodiment of FIG. 1A showing the folio 26 attached to the inside of the folded packet 12 in the manner just described.

The booklet 10 may also be used as a hand-out or for magazine drop-in advertising promotions. If such a use is desired, the folio 26 may be folded in any suitable manner.

Figure 2:
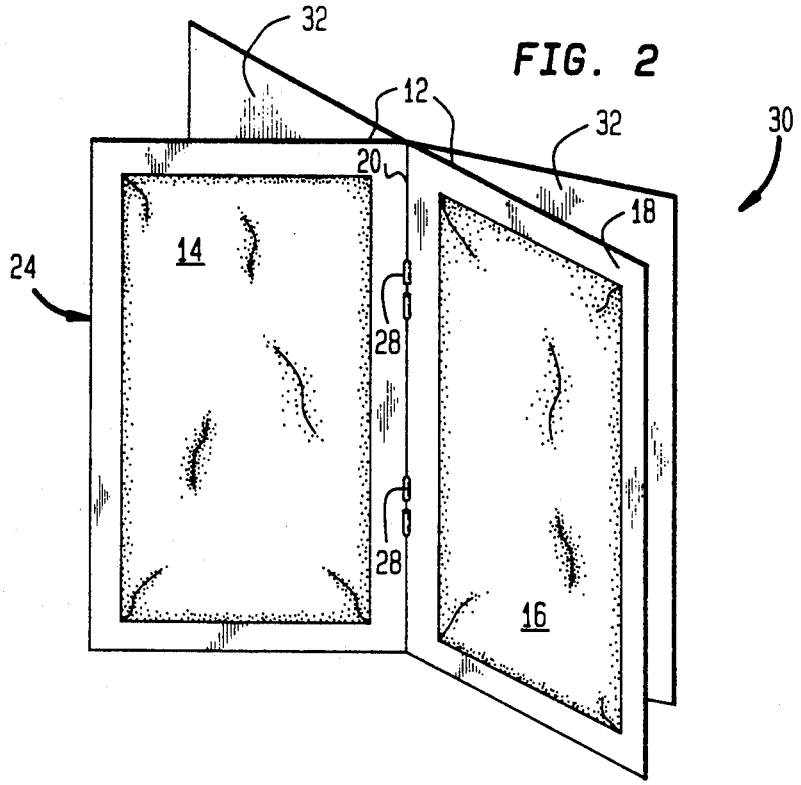
FIG. 2 is a first alternate embodiment of the invention with a two-fold folio on the outside of a two compartment packet.

A first alternate embodiment 30 shown in FIG. 2 has a two-fold folio 32 attached to the outside face 24 of the tandem packet 12. The folio 32 may have an address imprinted thereon, or an address label may be placed on the folio 32 for sending by direct mail. Other applications are also possible. For example, the first alternative embodiment of the booklet 30 may be used as an insert to a magazine, or other similar product insert.

Figure 3:
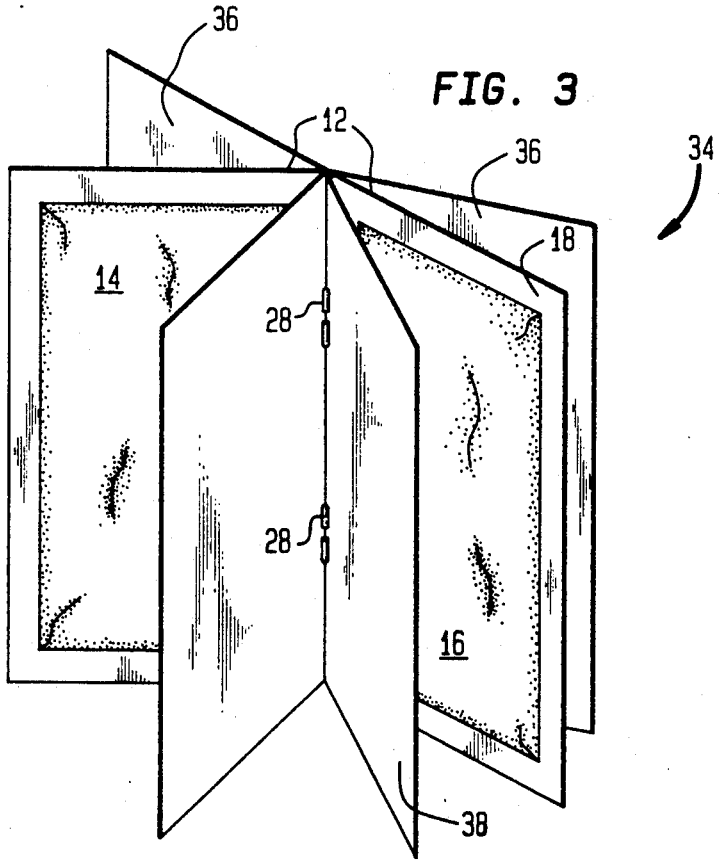
FIG. 3 is a second alternate embodiment showing the multi-compartment packet with folios attached to the inside and the outside.

A second alternate embodiment 34 shown in FIG. 3 comprises a tandem packet 12 with an outside folio 36 and an inside folio 38. The outside folio 36 may be used to mail the booklet 10 and the inside folio 38 may contain advertising information or promotional coupons. Alternatively, the booklet 34 may be used as an insert in a magazine, or as a hand-out, take-one sample.

While the invention has been described with reference to the preferred embodiment thereof, it will be appreciated by those of ordinary skill in the art that modifications can be made to the structure and elements of the invention without departing from the spirit and scope of the invention as a whole.

I claim:

1. A mailable apparatus comprising:

a multi-compartment means having at least two cells for respectively containing a product sample;

a continuous, foldable sealing zone for separating said cells;

printable material having substantially the same size and shape as said multi-compartment means; and, attaching means for attaching said printable material along said sealing zone to said multi-compartment means, wherein said multi-compartment means and said printable material are folded at least once along said continuous, foldable sealing zone to approximately the size of a postcard so that said apparatus can be mailed through the U.S. postal service.

2. The apparatus of claim 1 wherein when said apparatus is folded it forms a folded packet having an inside and an outside and wherein said apparatus further comprises:

addressable field means located on the outside of said apparatus for displaying a mailing address for said apparatus.

3. The apparatus of claim 2 wherein said cells of said multi-compartment emans are liquid tight and are of the sort acceptable to teh U.S. Postal Service for independent mailing through the U.S. mails.

4. The apparatus of claim 3 wherein said product samples in said cells are all of the same liquid material.

5. The apparatus of claim 4 wherein said printable material is attached to the outside of said apparatus so as to form a cover for said multi-compartment means.

6. The apparatus of claim 4 wherein said printable material is attached to theinside of said apparatus so as to form printed pages in said apparatus.

7. The apparatus of claim 4 wherein said attaching means comprises an adhesive.

8. The apparatus of claim 4 wherein said attaching means comprises stitching.

9. The apparatus of claim 4 wherein the dimensions of the apparatus when folded is approximately at least 3.5 inches by 5 inches.

* * * * *